US005749666A

United States Patent [19]

Yu

[11] Patent Number: 5,749,666

[45] Date of Patent: May 12, 1998

[54] EXPANDING FILE

[76] Inventor: Chung Cheng Yu, No. 12-5, Alley 1, Lane 31, Ta-Li St., Ta-Li City, Taichung, Taiwan

[21] Appl. No.: 617,367

[22] Filed: Mar. 18, 1996

[51] Int. Cl.[6] ..... B42F 13/06

[52] U.S. Cl. ..... 402/18; 402/4; 281/29; 281/31

[58] Field of Search ..... 402/4, 18, 14; 281/31, 15.1; D19/27, 26, 33; 40/359, 654.01, 537; 229/67.2, 67.1, 72

[56] References Cited

U.S. PATENT DOCUMENTS

| | | | |
|---|---|---|---|
| 1,488,616 | 4/1924 | Robbins | 229/67.1 |
| 2,302,035 | 11/1942 | Karlen | 402/18 |
| 3,227,471 | 1/1966 | Conkier | 281/31 |

FOREIGN PATENT DOCUMENTS

| | | | |
|---|---|---|---|
| 1046570 | 12/1958 | Germany | 40/359 |

OTHER PUBLICATIONS

Jacobs Gardner Office Supply Catalog, p. 268 items A–D, Dec. 1990.

*Primary Examiner*—Willmon Fridie, Jr.
*Attorney, Agent, or Firm*—Bacon & Thomas

[57] ABSTRACT

An expanding file includes an upper cover, a bottom cover and a plurality of plates which are disposed between the upper cover and the bottom cover. A flexible connecting member connects each pair of adjacent upper cover plates and bottom cover. A fastener binder which has a base portion having two ends is fixedly attached to at least one of the upper cover and the bottom cover by way of ultrasonic welding. Deformable extension parts extend from each of the two ends of the base portion such that a document can be securely positioned in the expanding file by extending the two extension parts through holes defined in the document and then pressing the extension parts toward the document.

3 Claims, 5 Drawing Sheets

EXPANDING FILE

BACKGROUND OF THE INVENTION

1. Field of the Invention

The present invention relates to an expanding file and more particularly, to an expanding file wherein a paper fastener binder is securely disposed to the expanding file by way of ultrasonic weld and the fastener binder has two deformable extension parts extending therefrom so as to position a document to the expanding file.

2. Brief Description of the Prior Art

A clip board is usually seen to clip papers or document by a clip member disposed thereto, the clip member generally includes a bottom board and a curved member which is connected to the bottom board by a spring to urge the curved member toward the clip board. The bottom board is riveted to the clip board therefore at least two rivets can been seen on a rear side of the clip board and this not only weakens a strength of the clip board but also is adverse to aesthetic principles. The conventional riveted clip member is deemed to damage the corrugated boards.

Furthermore, there is a kind of expanding file which is made of corrugated boards and each of the corrugated boards has a document folder disposed thereto such that document can be received in the document folder. However, the document received in the flexible plastic made document folder tends to slip from the document folder because the document folder equipped with no proper means to fixedly position the document. In addition, in the present market, a paper fastener binder is selectably disposed to the expanding file and which also is fixedly to the expanding file by rivets.

The present invention intends to provide an improved expanding file which has a paper fastener binder disposed to the expanding file by way of ultrasonic weld and the fastener binder has a deformable extension part extending from each one of two ends thereof so as to provide a proper strength to securely position document to the expanding file and thereby to mitigate and/or obviate the above-mentioned problems.

SUMMARY OF THE INVENTION

The present invention provides an expanding file which includes an upper cover, a bottom cover and a plurality of plates which are disposed between the upper cover and the bottom cover. A flexible connecting member connects each pair of adjacent upper cover, plates and bottom cover. A fastener binder having a base portion which has two ends and the base portion is fixedly disposed to at least one of the upper cover, the bottom cover and the plates by way of ultrasonic weld. A deformable extension part extends from each of the two ends of the base portion such that document can be securely positioned to the expanding file by extending the two extension parts through holes defined in the document and then pressing the extension parts toward the document.

It is an object of the present invention to provide an expanding file having a fastener binder disposed thereto by way of ultrasonic weld.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
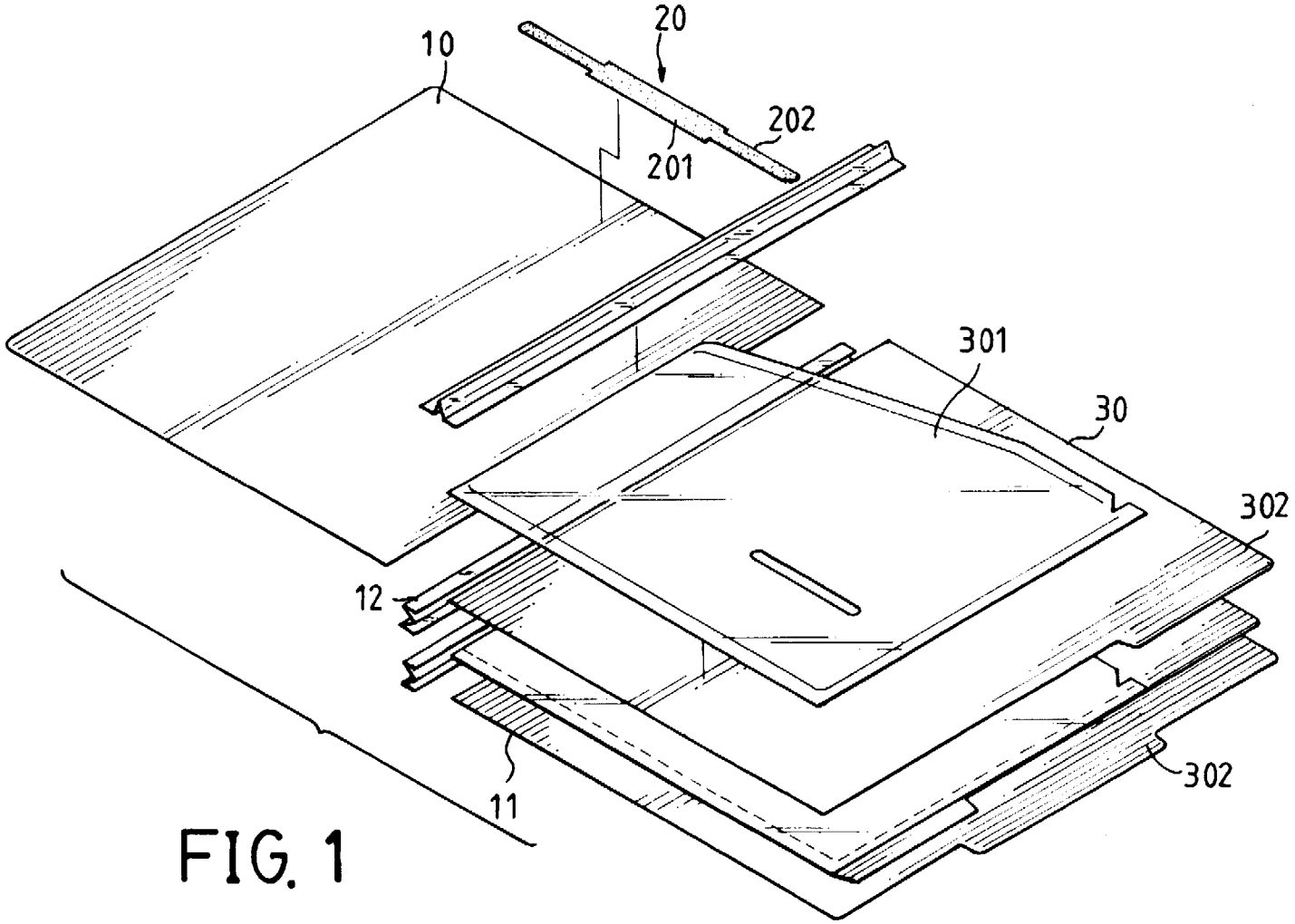
FIG. 1 is an exploded view of an expanding file which upper cover is turned to an inner side thereof in accordance with the present invention.
Figure 2:
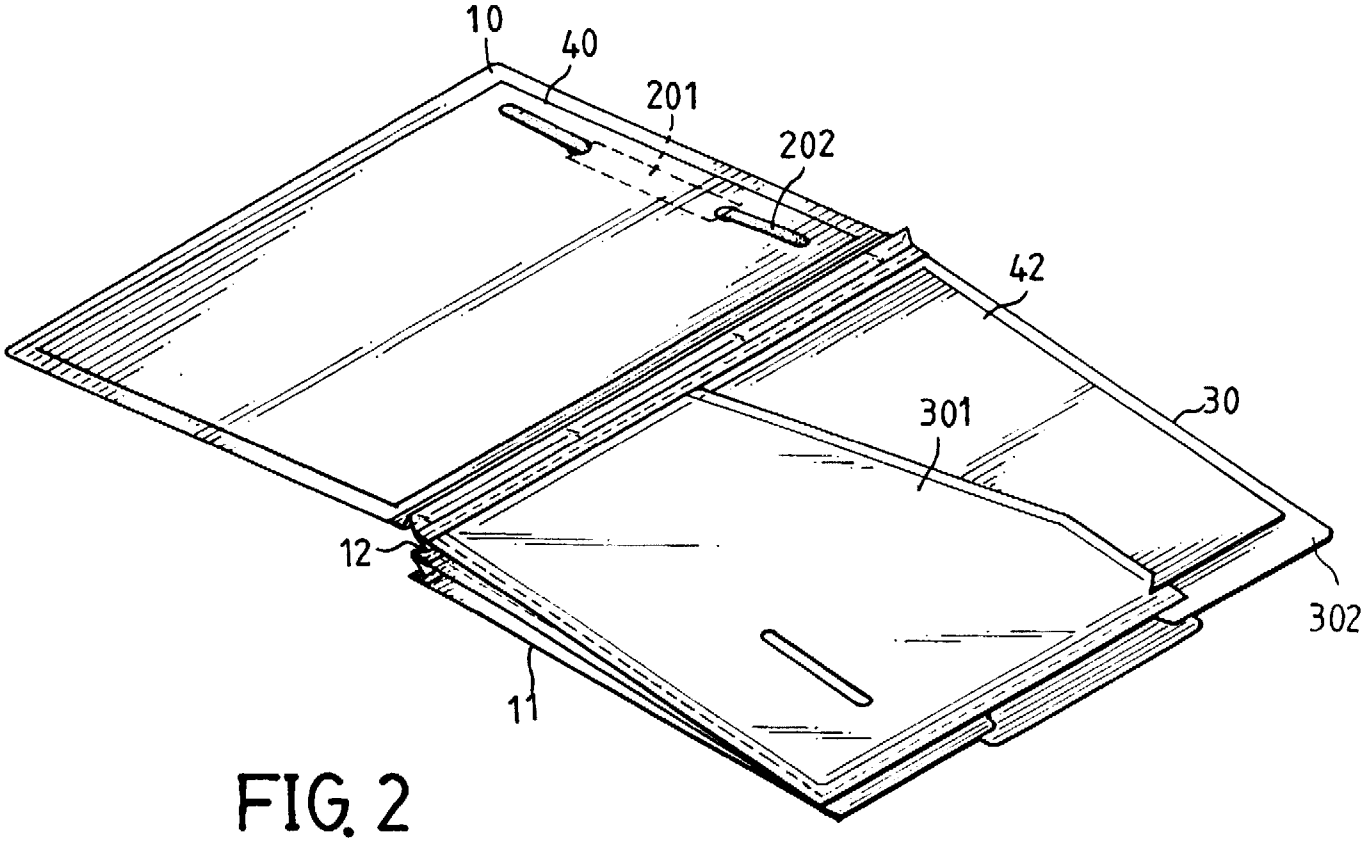
FIG. 2 is a perspective view of the expanding file.
Figure 3:
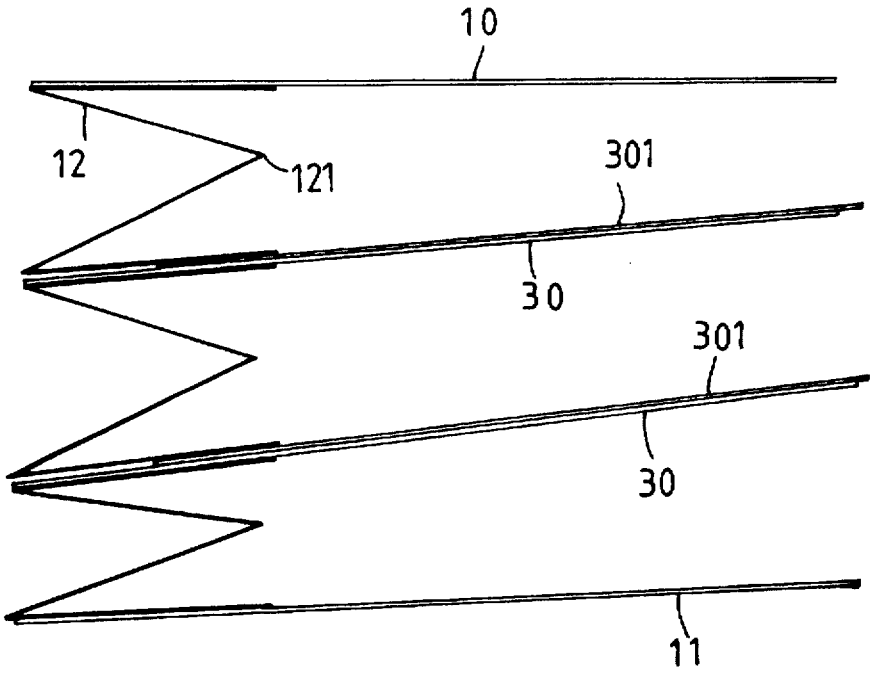
FIG. 3 is a side elevational view, partly in section, of the expanding file and shows a connecting member connecting the upper cover and the plate, the plate and the bottom cover.

Referring to the drawings and initially to FIGS. 1 through 3, an expanding file in accordance with the present invention generally includes an upper cover 10, a bottom cover 11 and three plates 30 arranged between the upper cover 10 and the bottom cover 11. Each of the upper cover 10, the bottom cover 11 and the plates 30 having an inner side and an outer side wherein the outer side of each of the plates 30 has a lid portion 302 extending laterally therefrom. Each of the plates 30 has a document folder 301 disposed thereto, the document folder 301 is made of transparent plastic material and has three sides and an open side for a document 42 (FIG. 2) to be inserted thereby, each of the three sides of the paper holder 301 is fixedly disposed to the plate 30 by way of ultrasonic weld.

An elongated connecting member 12 has a first side and a second side each extending along a longitudinal axis thereof, the first side and the second side thereof respectively fixedly disposed to one of two adjacent inner sides of the upper cover 10, the bottom cover 11 and the plates 30 by way of ultrasonic weld. The connecting member 12 is made of flexible material and has at least one fold line 121 longitudinally and centrally defined therein.

A fastener binder 20 having a base portion 201 and two extension parts 202, the base portion 201 having two ends and being fixedly to an inner side of the upper cover 10 by way of ultrasonic weld. The extension part 202 made of deformable material, such as a metal plate or metal wires disposed in plastic material, extending from each one of the two ends of the base portion 201.

Figure 4:
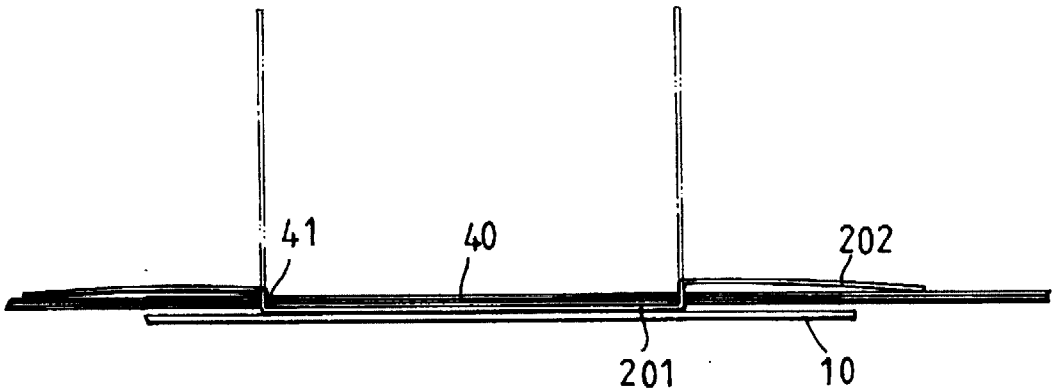
FIG. 4 is an end plan view of a document securely positioned to the expanding file by a fastener binder in accordance with the present invention.

Referring now to FIGS. 2 and 4, a document 40 comprising a plurality of sheets of papers has two holes 41 defined therethrough and is positioned to the inner side of the upper cover 10 by extending the two extension parts 202 of the fastener binder 20 through the holes 41 and then pressing the two extension parts 202 toward the document to position the document.

Figure 5:
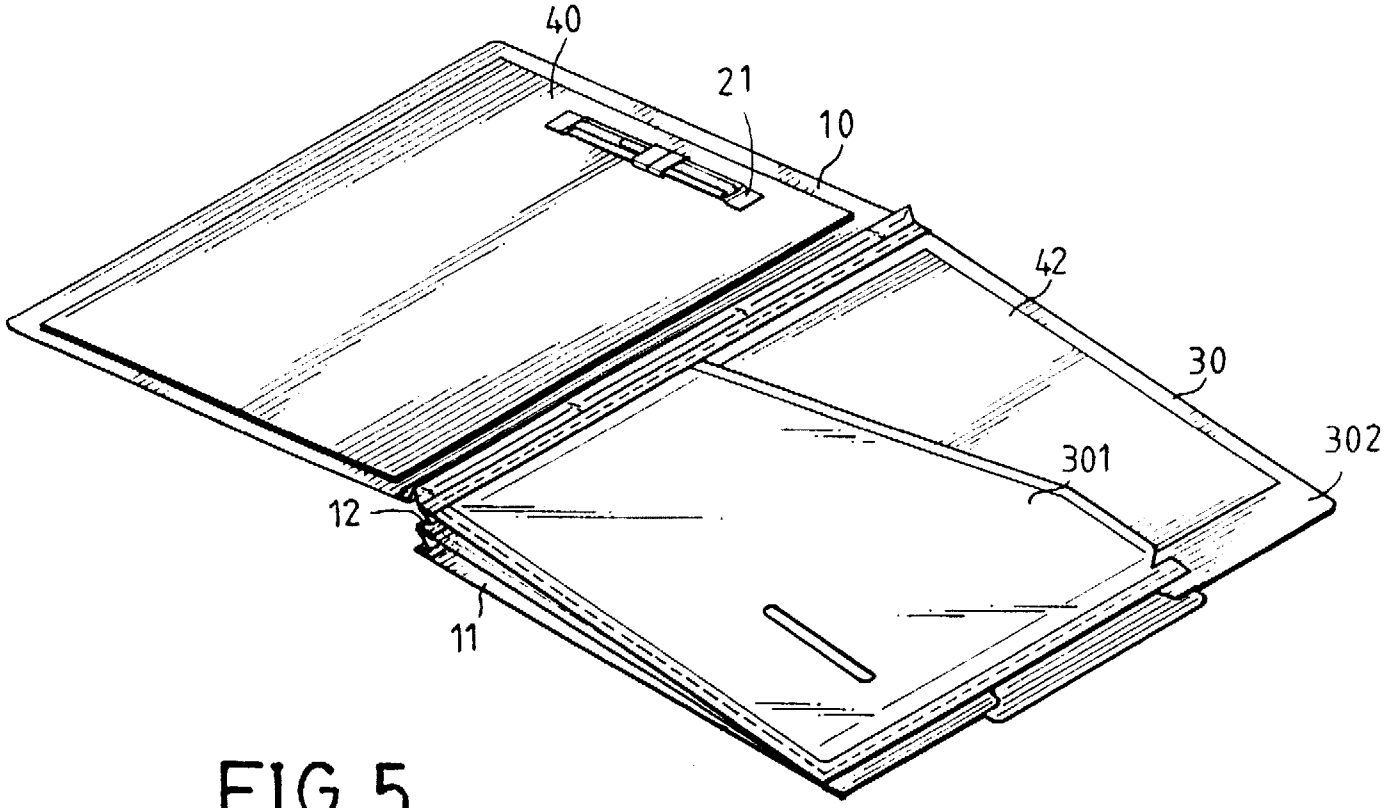
FIG. 5 is a perspective view of the expanding file wherein the fastener binder is used with a conventional pressing plate.

FIG. 5 shows that the fastener binder 20 can be used with a conventional pressing plate 21 as shown to position the document.

Accordingly, the fastener binder 20 and the paper folders 301 are fixedly to the expanding file by way of ultrasonic weld such that the expanding file has an aesthetic outer appearance and can be manufactured with low cost.

Although the invention has been explained in relation to its preferred embodiment, it is to be understood that many other possible modifications and variations can be made without departing from the spirit and scope of the invention as hereinafter claimed.

What is claimed is:

1. An expanding file comprising:

an upper cover, a bottom cover and at least one plate arranged between said upper cover and said bottom cover, each of said upper cover, said bottom cover and said plate having an inner side and an outer side;

a document folder having at least one open side, the document holder fixedly attached to the at least one plate;

an elongated connecting member having a first side and a second side each extending along a longitudinal axis thereof, said first side and said second side thereof respectively fixedly disposed to one of said two adjacent inner sides of said upper cover, said bottom cover and said plate, and a fastener binder, said fastener binder having a base portion with two ends and being fixedly attached to at least one of said upper cover, and said bottom cover by way of ultrasonic weld, a deformable extension part extending from each one of said two ends of said base portion.

2. The expanding file as claimed in claim 1 wherein said connecting member is made of flexible material and has at least one fold line longitudinally and centrally defined therein.

3. An expanding file comprising:

an upper cover, a bottom cover and at least one plate arranged between said upper cover and said bottom cover, each of said upper cover, said bottom cover and said plate having an inner side and an outer side;

a document folder having at least one open side the document holder fixedly attached to the at least one plate;

an elongated connecting member having a first side and a second side, said first side and said second side thereof respectively fixedly attached to one of said two adjacent inner sides of said upper cover, said bottom cover and said plate, said connecting member being made of flexible material and having at least one fold line longitudinally and centrally defined therein, and a fastener binder, said fastener binder having a base portion with two ends and being fixedly attached to at least one of said upper cover, and said bottom cover by way of ultrasonic weld, a deformable extension part extending from each one of said two ends of said base portion.

* * * * *